United States Patent [19]

Goessler et al.

[11] Patent Number: 4,845,340

[45] Date of Patent: Jul. 4, 1989

[54] ELECTRIC RADIANT HEATING ELEMENT FOR HEATING A PLATE PARTICULARLY A GLASS CERAMIC PLATE

[75] Inventors: Gerhard Goessler, Oberderdingen; Eugen Wilde, Knittlingen; Robert Kicherer, Oberderdingen, all of Fed. Rep. of Germany

[73] Assignee: E.G.O. Elektro-Gerate Blanc u. Fischer, Fed. Rep. of Germany

[21] Appl. No.: 188,262

[22] Filed: Apr. 29, 1988

[30] Foreign Application Priority Data

May 1, 1987 [DE] Fed. Rep. of Germany ... 8706277[U]

[51] Int. Cl.[4] ..... H05B 3/74

[52] U.S. Cl. ..... 219/464; 219/449

[58] Field of Search ..... 219/464, 448, 449, 450, 219/459, 460, 457

[56] References Cited

U.S. PATENT DOCUMENTS

| | | | |
|---|---|---|---|
| 3,710,076 | 1/1973 | Frazier | 219/459 |
| 4,243,874 | 1/1981 | Fischer | 219/457 |
| 4,350,875 | 9/1982 | McWilliams | 219/449 |
| 4,371,780 | 2/1983 | Gössler | 219/448 |
| 4,633,238 | 12/1986 | Goessler | 219/449 |
| 4,697,068 | 9/1987 | Schreder | 219/449 |

*Primary Examiner*—Teresa J. Walberg

*Attorney, Agent, or Firm*—Steele, Gould & Fried

[57] ABSTRACT

In the case of an electric radiant heating element (11) positioned below a glass ceramic plate (12), a rod-like temperature sensor (23) of a thermostat (24) projects over and beyond the heating zone. There are spacers (35) for maintaining a minimum spacing between the insulator (15), which carries the heating resistors (20), and the glass ceramic plate (12).

16 Claims, 2 Drawing Sheets

ELECTRIC RADIANT HEATING ELEMENT FOR HEATING A PLATE PARTICULARLY A GLASS CERAMIC PLATE

BACKGROUND OF THE INVENTION

1. Field of the Invention

The invention relates to an electric radiant heating element for heating a plate, particularly a glass ceramic plate.

2. Prior Art

Such radiant heating elements conventionally have a temperature sensor, whose outer tube is made from an insulating material, particularly quartz or quartz glass. It is either incorporated into the expansion system of the sensor, in that it forms a tube with a low expansion coefficient in which is located a tension member with a higher expansion coefficient, or it is mounted on an expansion tube. It is necessary in order to ensure the necessary air gaps and/or creepage distances in the space between the heating resistors and the plate through which the temperature sensor passes. It must be borne in mind that glass ceramic plates are electrically conductive at the working temperature, so thaty the necessary insulating gaps must be maintained here.

These quartz glass tubes are not only relatively expensive, but are also fragile and require special measures when they are fitted to the radiant heating element.

SUMMARY OF THE INVENTION

An object of the present invention is consequently to provide an electric radiant heating element, where there is no need to individually insulate the temperature sensor.

This object is inventively achieved by at least one spacer for maintaining a minimum spacing between the insulator or the heating resistors arranged thereon and the temperatures sensor or plate.

This ensures a minimum air gap between the sensor tube, which is preferably metallic and optionally also grounded, and the heating resistors. Tests have revealed that the most significant risk of a possibly dropping below a possibly predetermined air gap, results from the fact that in continuous operation the insulator, which can be in two-layer form, is curved upwards and therefore brings the heating resistors closer to the sensor tube. This is reliably avoided by the spacer. Simultaneously the relatively stiff sensor tube also ensures that the insulator remains flat. The spacers need not constantly engage on the temperature sensor. There can instead by a certain spacing if it is ensured that the desired minimum spacing is still provided in the case of engagement of the spacer. This minimum spacing can e.g. be 3 mm, whereas the total air gaps, whilst incorporating the temperature sensor spacing from the plate, should be approximately 8 mm.

Preferably the spacer is formed by at least one projection of the insulator, which is in particular located in an upheated, central region of the radiant heating element and can be shaped in one piece with the insulator material, e.g. during the vacuum forming thereof. Particular preference is given to a construction with two spaced projections provided in the central region.

In addition to or in place of the projection engaging on the temperature sensor, it is possible to provide a sensor for engaging on the underside of the plate. In this case it keeps constant the spacing between the plate and the insulator, so that the latter cannot "grow" towards the temperature sensor. A combination of both measures is also conceivable, in that e.g. a projection emanating from the insulator has a contact or bearing surface for the plate and a support for the temperature sensor. This can be realized in the form of a staggered cam or a projection with a hole for the temperature sensor.

According to another embodiment on the sensor is mounted a spacer, e.g. in the form of a circular or rectangular disk, which is provided for engaging on the insulator and/or on the plate. As a result of an asymmetrical construction of this plate, it is also possible to set different spacings with respect to the underside of the glass ceramic plate and the insulator.

As a result of their sensitive quartz tubes, the hitherto known temperature sensors have had to be very flexibly arranged and were preferably placed in top-open slots of an otherwise all-round edge of the insulator and a support tray surrounding the same and in said recesses had a clearance so that no stresses could occur. However, this led to a heat bridge to the exterior, so that not only was energy lost, but also there was unnecessary heating of the hob support. Through the possibility of using a rigid metallic sensor, it is now possible to substantially rigidly mount the temperature sensor and therefore the complete regulator, in that it is e.g. inserted with its usually somewhat tapered free end into a support tray hole which is closed at the top, whilst the switch side can be fixed by a holding angle bracket to the support tray of the radiant heating element. The insulating rims or edges can also be closed towards the top and therefore provide a more complete insulation. Therefore the temperature sensor can be inserted in relatively narrow holes in the edge and essentially forms a seal with respect to the outside.

Further advantages and features of the invention can be gathered from the subclaims, description and drawings, whereby the individual features can be realized singly or in the form of subcombination in any embodiment of the invention, as well as in similar or related fields, e.g. in connection with the heating of baking ovens or the like.

BRIEF DESCRIPTION OF THE DRAWINGS

Embodiments of the invention are described hereinafter relative to the drawings, wherein.

DETAILED DESCRIPTION OF THE PREFERRED EMBODIMENTS

Figure 1:
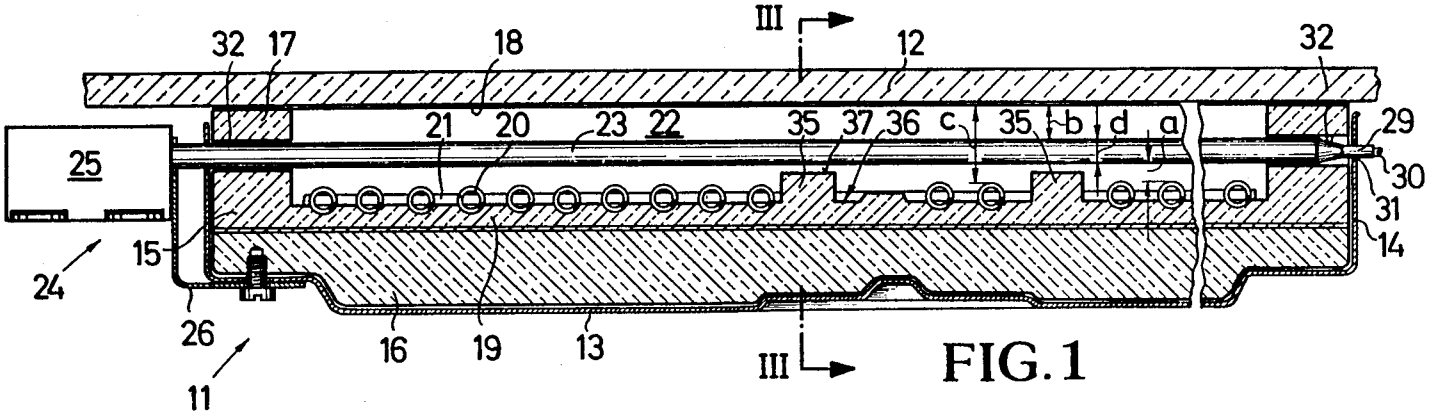
FIG. 1 is a broken away cross-section through a radiant heating element, the glass ceramic plate 12 being shown in elevation from its edge.
Figure 3:
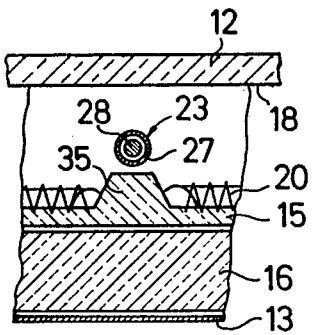
FIG. 3 is a section along line III in FIG. 1.
Figure 2:
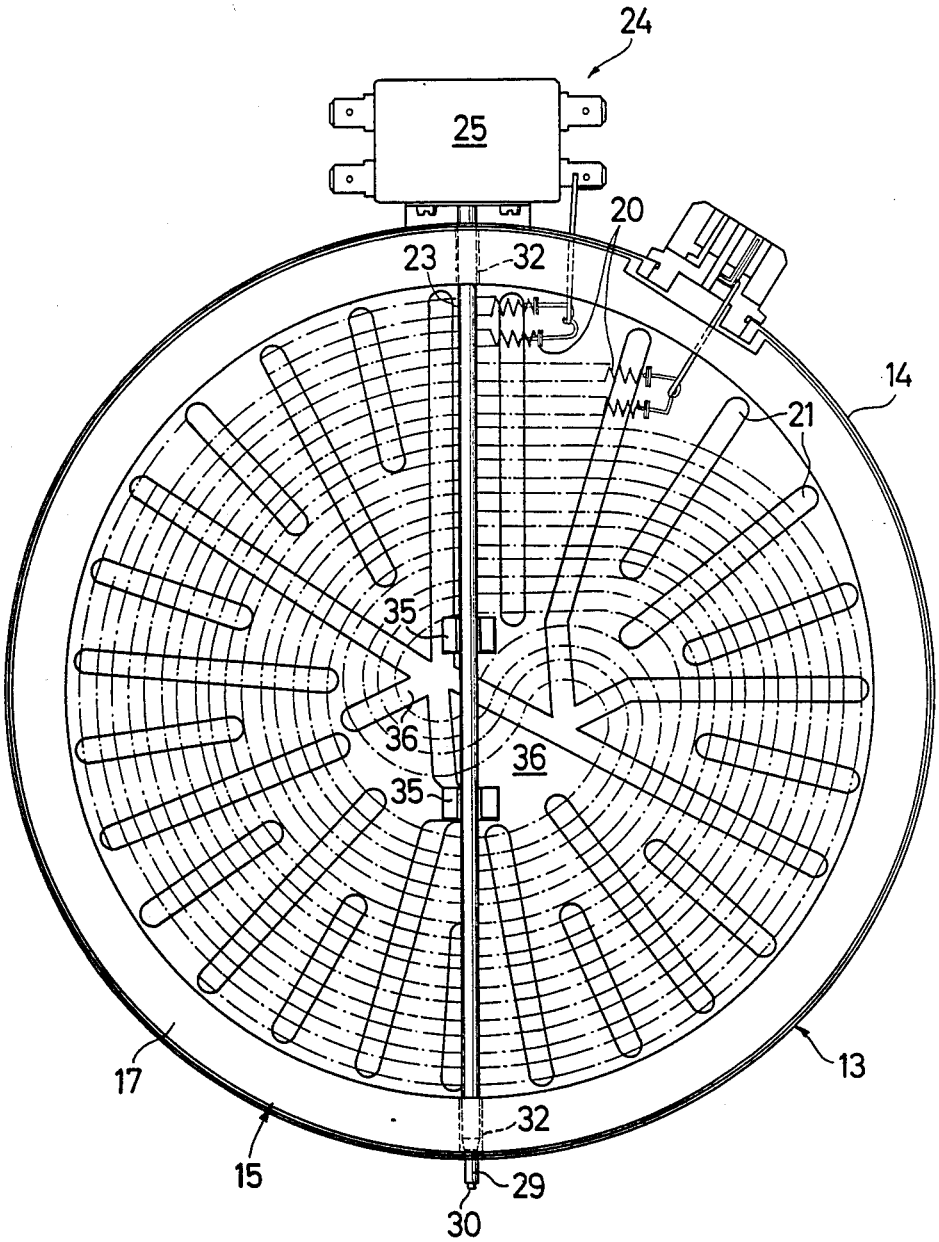
FIG. 2 is a plan view of the radiant heating element according to FIG. 1.

FIGS. 1 to 3 show a radiant heating element 11 for heating a glass ceramic plate 12 of a hob or cooker. The radiant heating element is pressed by spring elements (not shown) against the underside of plate 12. The heating element comprises a sheet metal support tray 13 with a bottom and an all-round, upright or raised edge or rim 14, in which is located an insulator 15, below which is placeda further insulating layer 16. Whereas the insulator 15 is made from a relatively solid, high temperature-resistant insulating material based on ceramic fibers and produced by a vacuum suction process, insulating layer 16 is made from a good insulating, but less solid insulating material, e.g. a bulk material of microporous, pyrogenic silicic acid.

The insulator 15 is also dish-shaped with a relatively thin bottom 19 and an all-round edge 17, which projects upwards somewhat over the edge 14 of the sheet metal support tray and is pressed by pressing springs against the underside 18 of plate 12.

To the top of bottom 19 are fixed electrical heating resistors 20 in the form of wire coils. In the present embodiment this takes place by partly pressing the coils into the still moist shaped blank of the insulator 15. The bottom has radially directed ribs 21, into which the heating coils are pressed somewhat further, whereas they otherwise only penetrate slightly into the insulator. This ensures a reliable fixing of the heating coils, which only slightly prevents irradiation. However, any other fixing mode is possible, e.g. by cement or the like and it is also possible to use other insulating materials or configurations of the insulator within the scope of the invention.

Through the space 22 formed between the bottom 19 with the heating resistors 20 arranged thereon and the underside 18 of plate 12, as well as the all-round edge 17 passes a temperature sensor 23 of a temperature-sensitive switch 24, which is a thermal cutout or thermostat, which must ensure that the temperature of the underside 18 of plate 12 is restricted to a specific value, because e.g. on overheating glass ceramic plates they suffer permanent damage. The head 25 of temperature-sensitive switch 24, which at least contains a snap-action switch and optionally a second contact as a signal contact for indicating the hot state of the plate, is fixed to an angular holder 26 outside the insulator and which is screwed to the support tray 13. Temperature sensor 23 is elongated and rod-like. It comprises a metal tube 27 in which is located a ceramic rod 28 (FIG. 3), which has a lower thermal expansion coefficient than the metal tube, so that a snap-action switch can be operated as a result of the linear expansion difference in the switch head. The outer tube 27 tapers at the free end 29 of temperature sensor 23 and is provided with an internal thread, so that the switch can be adjusted by means of an adjusting screw 30 on which is supported the ceramic rod 28. This construction of the temperature-sensitive switch is extremely simple and robust, because the metal tube 27 can be largely firmly connected to the switch head 25 and also has no breaking tendency. Thus, advantageously both ends of the temperature sensor can be fixed, i.e. to the side of the switch by securing to the switch head 25 and the holder 26 and on its free end 29 by inserting in a matching opening 31 in the edge 14 of the sheet metal support tray. Like openings 32, opening 31 can be of a circular nature and can be located in the edge 17 of the insulator, whereby said openings are closed towards the glass ceramic plate. This ensures that there are no unnecessary heat losses and the temperature sensor is received in fixed manner on the radiant heating element and contributes to the reinforcement thereof. However, there can be a certain longitudinal displacement of the free end thereof in the manner resulting from its linear expansion.

Thus, the temperature sensor passes through space 22 in such a way that it has a distance a from the heating resistor and a distance b from the plate. On adding thereto the diameter d of the temperature sensor 23, then a total distance c from the underside of plate 12 is obtained. Distance a must not drop below a certain minimum amount and this also applies with respect to the total distance a and b, so as to meet the safety specifications. Nevertheless, distance c must be as small as possible, so that the heating system can be as close as possible to the glass ceramic plate and also so as to keep the total height or depth of the radiant heating element as small as possible and therefore make the insulation by insulating layers 15, 16 as great as possible.

According to the invention, a minimum value for distance a is ensured by discrete spacers 35, whereof two are shown in the central region in FIG. 1. FIG. 2 shows that they are in each case located in the unheated regions 36, which are formed by a S-shaped loop of the double horizontal spirals, in which the heating resistors are placed. There are in each case two heating resistors in parallel in the form of a spiral, which turns in the center and passes out again parallel to the incoming spiral. These projections can be rectangular projections shaped out of the insulator material during its shaping and which have a rectangular, pyramidal, circular or conical shape. Admittedly they cover the underside of the temperature sensor over the length thereof, but this is advantageous, because as a result the power release during the heating process is somewhat increased. There need only be a single spacer 35, or several of these, which can also be provided at other points of the temperature sensor. However, two spacers spaced from one another in the central region have proved particularly advantageous.

Figure 4:
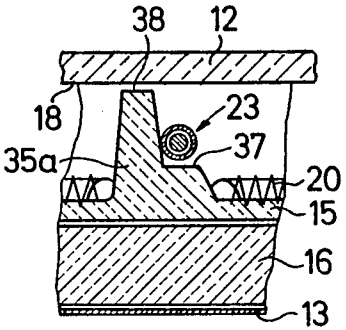

The variant shown in FIG. 4 has, in the case of an otherwise identical construction, a spacer **35*a* which, like the spacer according to FIGS. 1 to 3, has a bearing surface 37 for temperature sensor 23, but additionally has a bearing surface 38 facing the underside 18 of plate 12 and can be supported on the latter. The spacer formed by projection 35*a*** consequently has roughly a L-shape, but can also be U-shaped.

Figure 5:
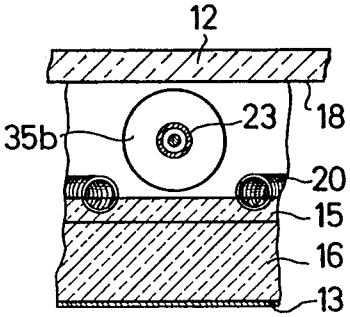
FIGS. 4 and 5 are two variants, in each case represented in accordance with FIG. 3.

In FIG. 5 the spacer **35*b* is located on the temperature sensor instead of on the insulator and comprises a not very thick disk located in the longitudinal direction of the temperature sensor and which is mounted on the latter. It also ensures the spacing of the temperature sensor both with respect to the insulator 15 and the plate 12**, but through a corresponding one-sided construction need only ensure one or other spacing, or could ensure different spacings.

It is common to all the embodiments that they ensure in a single and uncomplicated manner that there is always an adequate safety spacing between the live heating resistors and the temperature sensor, as well as the glass ceramic plate. Whilst the spacing between the plate and the temperature sensor, particularly in the case of a relatively firm fixing thereof in accordance with the invention is hardly likely to change, all the constructions ensure that the insulator, which is naturally made from a relatively flexible material, will not inadmissibly approach the temperature sensor. This is also ensured by an embodiment in which the spacer only ensures the spacing between the insulator and the plate, i.e. a construction according to FIG. 4 without the bearing surface 37.

This leads to an extremely robust, highly stressable, easily installable and easily manufacturable radiant heating element, which fully complies with the safety requirements. As the temperatures sensor does not require the additional quartz tube, it can be made with a smaller diameter d, which once again reduces the overall height. The sensor tube can be grounded, so that even in the case of the glass ceramic plate breaking it is located as a protecting grounded component over the heating system and e.g. ensures that a "punctured" cooking utensil is not made live.

We claim:

1. Electric radiant heating element for heating hotplate means, in which electric heating resistor means are arranged on an insulator spaced from the hotplate means and in which a rod-like temperature sensor of a thermostat projects between the insulator and the hotplate means over a coherent heating zone of the radiant heating element bounded by a wall, comprising:

spacing means for maintaining a minimum spacing between the temperature sensor and at least one of the heating resistor means arranged on the insulator and the hotplate means, said spacing means including at least one discrete spacer positioned at a distance from said wall of said electric heating element defining boundaries of the coherent heating zone.

2. Radiant heating element according to claim 1, wherein the hotplate means is a glass ceramic hotplate.

3. Radiant heating element according to claim 2, wherein the spacing means is in an unheated central region of the radiant heating element.

4. Radiant heating element according to claim 1, wherein spacing means are formed by at least one projection of the insulator.

5. Radiant heating element according to claim 1, wherein the spacing means has a bearing surface facing the temperature sensor.

6. Radiant heating element according to claim 1, wherein the spacing means has a bearing surface facing an underside of hotplate means.

7. Radiant heating element according to claim 1, wherein there are at least two, spaced cam-like projections arranged as spacing means in the longitudinal direction of the temperature sensor.

8. Radiant heating element according to claim 1, wherein the spacing means are integral with the insulator.

9. Radiant heating element according to claim 8, wherein the spacing means are active as spacers between the temperature sensor and the insulator and the temperature sensor and the hotplate means.

10. Radiant heating element according to claim 1, wherein the spacing means are at least on one insulating member provided on the temperature sensor.

11. Radiant heating element according to claim 1, wherein the temperature sensor comprises a metallic outer tube.

12. Radiant heating element according to claim 1, wherein the temperature sensor is secured at its both ends to a rim of the heating element.

13. Radiant heating element according to claim 1, wherein a free end of the temperature sensor is guided substantially in the lateral direction in an opening of a rim of a support tray containing the insulator, the opening being closed towards the hotplate means.

14. Radiant heating element according to claim 1, wherein a free end of the temperature sensor is guided substantially in the lateral direction in an opening of a rim of the insulator, the opening being closed towards the hotplate means.

15. Electric heating element for heating hotplate means, in which electric heating resistor means are arranged on an insulator spaced from the hotplate means and in which a rod-like temperature sensor of a thermostat projects between the insulator and the hotplate means over a heating zone of the radiant heating element, comprising:

spacing means for maintaining a minimum spacing between the temperature sensor and at least one of the heating resistor means arranged on the insulator and the hotplate means, the spacing means being least one insulating member provided on the temperature, and sensor in a form of at least one disk mounted substantially centrally on the temperature sensor.

16. Electric radiant heating element for heating hotplate means, in which electric heating resistor means are arranged on an insulator spaced from the hotplate means and in which a rod-like temperature sensor of a thermostat projects between the insulator and the hotplate means over a heating zone of the radiant heating element, comprising:

spacing means for maintaining a minimum spacing between the temperature sensor and at least one of the heating resistor means arranged on the insulator and the hotplate means, at least two spaced, discrete cam-like projections being arranged as spacing means in a longitudinal direction of the temperature sensor.

* * * * *

UNITED STATES PATENT AND TRADEMARK OFFICE

CERTIFICATE OF CORRECTION

PATENT NO. : 4,845,340

DATED : July 4, 1989

INVENTOR(S) : Goessler et al.

It is certified that error appears in the above-identified patent and that said Letters Patent is hereby corrected as shown below:

Column 1, line 24 delete "thaty" and insert --that--.

Column 1, line 39 delete "temperatures" and insert --temperature--.

Column 1, line 52 delete "by" and insert --be--.

Column 1, line 67 delete "sensor" and insert --spacer--.

Column 2, line 49 before "broken away" insert "partly"

Cancel claim 1

At line 1 of each of claims 2,4-8 and 10-14 delete "1" and insert --15 or 16--.

Claim 15, line 13 after "temperature" delete ", and".

Signed and Sealed this

Twenty-fifth Day of December, 1990

*Attest:*

HARRY F. MANBECK, JR.

*Attesting Officer*

*Commissioner of Patents and Trademarks*